US007785482B2

(12) United States Patent
Subramanian et al.

(10) Patent No.: US 7,785,482 B2
(45) Date of Patent: Aug. 31, 2010

(54) METHOD OF MAKING AN IGNITION DEVICE

(75) Inventors: Kanakasabapathi Subramanian, Clifton Park, NY (US); Richard Joseph Saia, Niskayuna, NY (US); Aaron Jay Knobloch, Rexford, NY (US); David Joseph Najewicz, Prospect, KY (US); Nicholas Okruch, Jr., Mt. Washington, KY (US)

(73) Assignee: General Electric Company, Niskayuna, NY (US)

( * ) Notice: Subject to any disclaimer, the term of this patent is extended or adjusted under 35 U.S.C. 154(b) by 829 days.

(21) Appl. No.: 11/296,247

(22) Filed: Dec. 7, 2005

(65) Prior Publication Data

US 2007/0125745 A1 Jun. 7, 2007

(51) Int. Cl.
*H01B 13/00* (2006.01)

(52) U.S. Cl. ..... 216/16; 431/262; 219/260

(58) Field of Classification Search ..... 216/16, 216/2; 219/270, 260; 431/267, 268, 260, 431/262

See application file for complete search history.

(56) References Cited

U.S. PATENT DOCUMENTS

| | | | | |
|---|---|---|---|---|
| 6,507,097 | B1 * | 1/2003 | Goetz et al. | 257/678 |
| 6,786,716 | B1 * | 9/2004 | Gardner et al. | 431/268 |
| 7,176,417 | B2 * | 2/2007 | Johnsgard et al. | 219/444.1 |
| 2002/0084510 | A1 | 7/2002 | Jun et al. | 257/536 |
| 2004/0058479 | A1 | 3/2004 | Matsuura et al. | 438/123 |

FOREIGN PATENT DOCUMENTS

JP 08122161 A * 5/1996

* cited by examiner

*Primary Examiner*—Roberts Culbert
(74) *Attorney, Agent, or Firm*—Richard D. Emery

(57) ABSTRACT

A method of manufacturing an ignition device is provided. The method includes patterning a plurality of resistors on a membrane to form heating elements and thermally isolating the heating elements from an external environment via a cavity disposed adjacent to the heating elements.

20 Claims, 10 Drawing Sheets

METHOD OF MAKING AN IGNITION DEVICE

BACKGROUND

The invention relates generally to gas appliances, and more particularly to ignition devices for igniting a flow of gas in gas appliances and other gas-fired equipment. The invention may be applied to any application where ignition of a fuel air mixture is required.

Conventional gas appliances, such as those found in households, have one or more burners in which gas is mixed with air and burned at a cooktop or in an enclosed space, such as an oven. Various types of igniters are employed in such gas appliances for igniting the flow of gas. For example, in some systems spark igniters are employed that generate a spark to ignite the gas flowing to the burner. In certain other systems, ceramic hot surface igniters are employed that include heating elements for generating sufficient heat to ignite the gas supplied to the burner.

In certain systems, silicon carbide or silicon nitride hot surface igniters are employed for igniting the gas flow. Some of the problems with these conventional igniters are that they are porous, fragile, power hungry, relatively expensive and are fairly slow to reach ignition temperature. In addition, the resistance versus temperature characteristics of these conventional silicon carbide igniters may alter or drift over time, thereby adversely affecting their reliability.

Unfortunately, existing hot surface igniters need substantially high power for operation and can require an unacceptably long time to reach the required temperature for ignition. Further, heating elements of the igniters are exposed to the environment, resulting in accelerated failure of such elements due to degradation and contamination of the elements. Additionally, such igniters are often subjected to impacts from an operator during routine cleaning and maintenance, which may cause the igniter to break. Furthermore, such igniters require precise control of the voltage supplied to the heating elements. For example, a relatively high voltage may result in premature failure of the heating elements. Similarly, an applied voltage less than the required voltage may result in poor performance of the igniter.

Accordingly, it would be desirable to develop an ignition device for a gas appliance that has reduced power and voltage requirements. It would also be advantageous to develop an ignition device that requires relatively less time to reach the required ignition temperature, and is more robust and reliable.

BRIEF DESCRIPTION

Briefly, according to one embodiment a method of manufacturing an ignition device is provided. The method includes patterning a plurality of resistors on a membrane to form heating elements and thermally isolating the heating elements from an external environment via a cavity disposed adjacent to the heating elements.

In another embodiment, a method of manufacturing an ignition device is provided. The method includes depositing a thermal oxide layer on front and back sides of a substrate and depositing an electrically conductive material on the front and back sides of the substrate. The method includes etching the electrically conductive material on the front side of the substrate to form heating elements on the substrate and depositing a non-electrically conductive material adjacent to the electrically conductive material. The method also includes etching the non-electrically conductive materials on the front side of the substrate to form contact pad openings to the electrically conductive material.

DRAWINGS

These and other features, aspects, and advantages of the present invention will become better understood when the following detailed description is read with reference to the accompanying drawings in which like characters represent like parts throughout the drawings, wherein.

DETAILED DESCRIPTION

Figure 1:
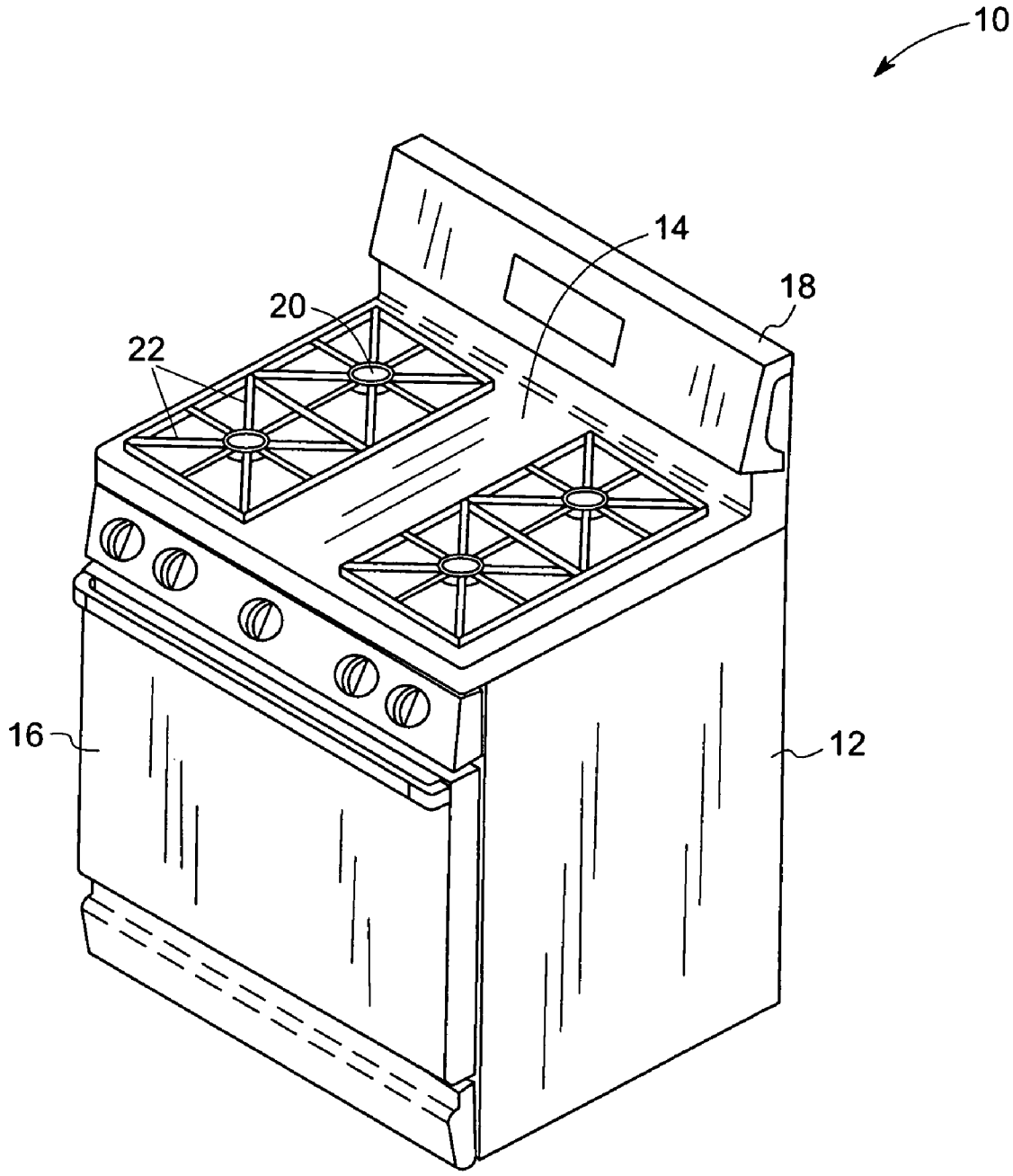
FIG. 1 is a diagrammatical illustration of a gas range having an ignition device in accordance with aspects of the present technique.

As discussed in detail below, embodiments of the present technique function to provide an ignition device for gas range and cooktop applications. Although the present discussion focuses on ignition devices for a gas range, the ignition devices may be employed in other applications, such as gas heater devices, gas ovens, gas boils, gas kilns, and so forth. Turning now to the drawings and referring first to FIG. 1, an exemplary gas range 10 is illustrated. The gas range 10 includes a body 12 and a cooktop 14. Further, the gas range includes an oven 16 positioned below the cooktop 14. A range backsplash 18 extends upwards of the cooktop 14 and may include control features for controlling the operational parameters of heating elements for the cooktop 14 and the oven 16.

In the illustrated embodiment, the gas range 10 includes four gas burner assemblies 20 positioned in the cooktop 14 and configured to receive a flow of gas for combustion. However, a greater or lesser number of the gas burner assemblies 20 may be envisaged. Further, each burner assembly 20 extends upwardly and a grate 22 is positioned over each burner assembly 20. In the present embodiment, each of the grates 22 includes a flat surface thereon for supporting the cooking utensils over the burner assembly 20. In the illustrated embodiment, an ignition device is disposed adjacent each burner assembly 20 and is configured to ignite the gas flow received by the gas burner assembly 20. The ignition device employed in the gas range 10 will be described in a greater detail below.

Figure 2:
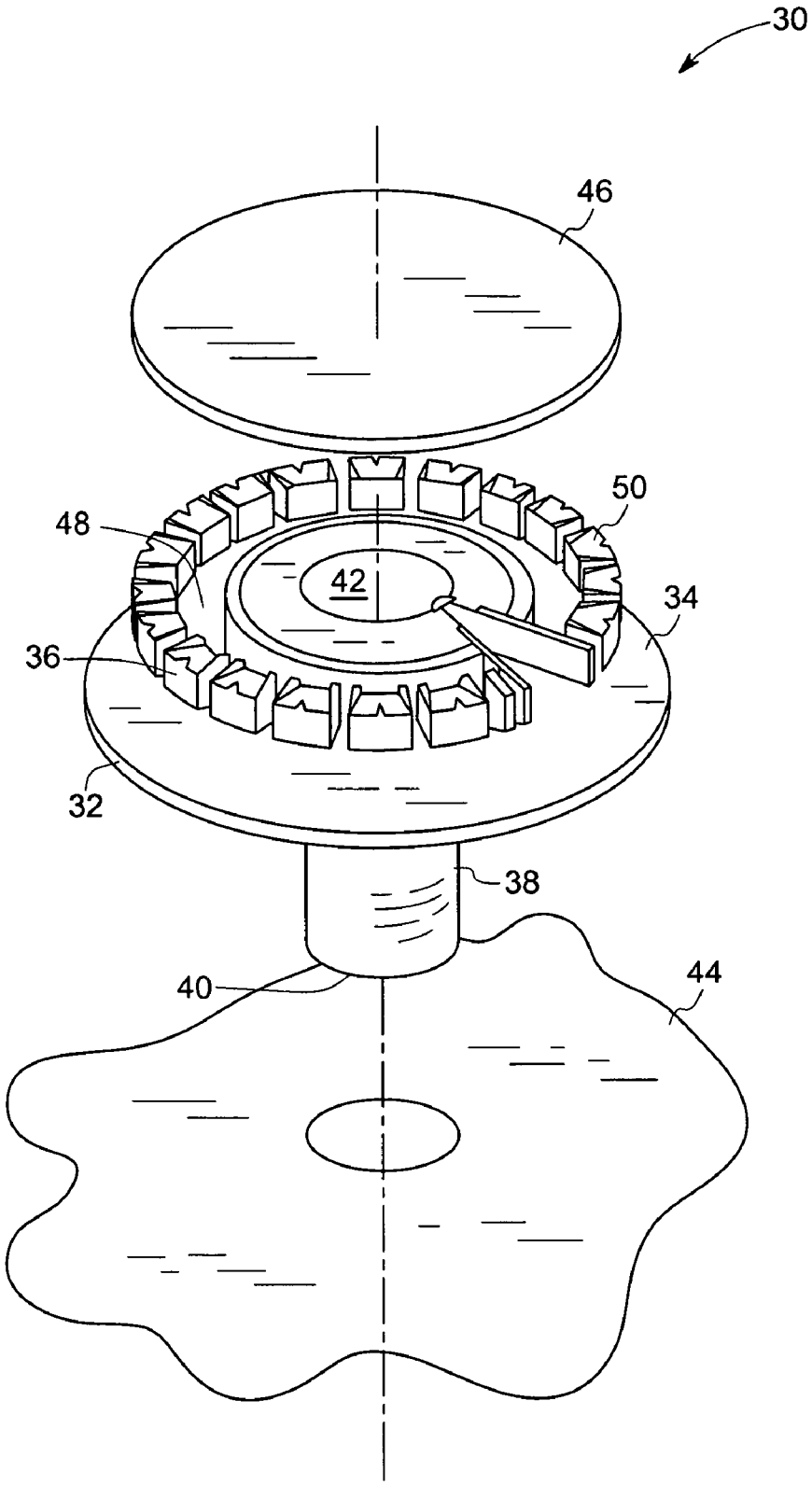
FIG. 2 is an exploded perspective view of a gas burner employed in the gas range of FIG. 1 in accordance with aspects of the present technique.
Figure 3:
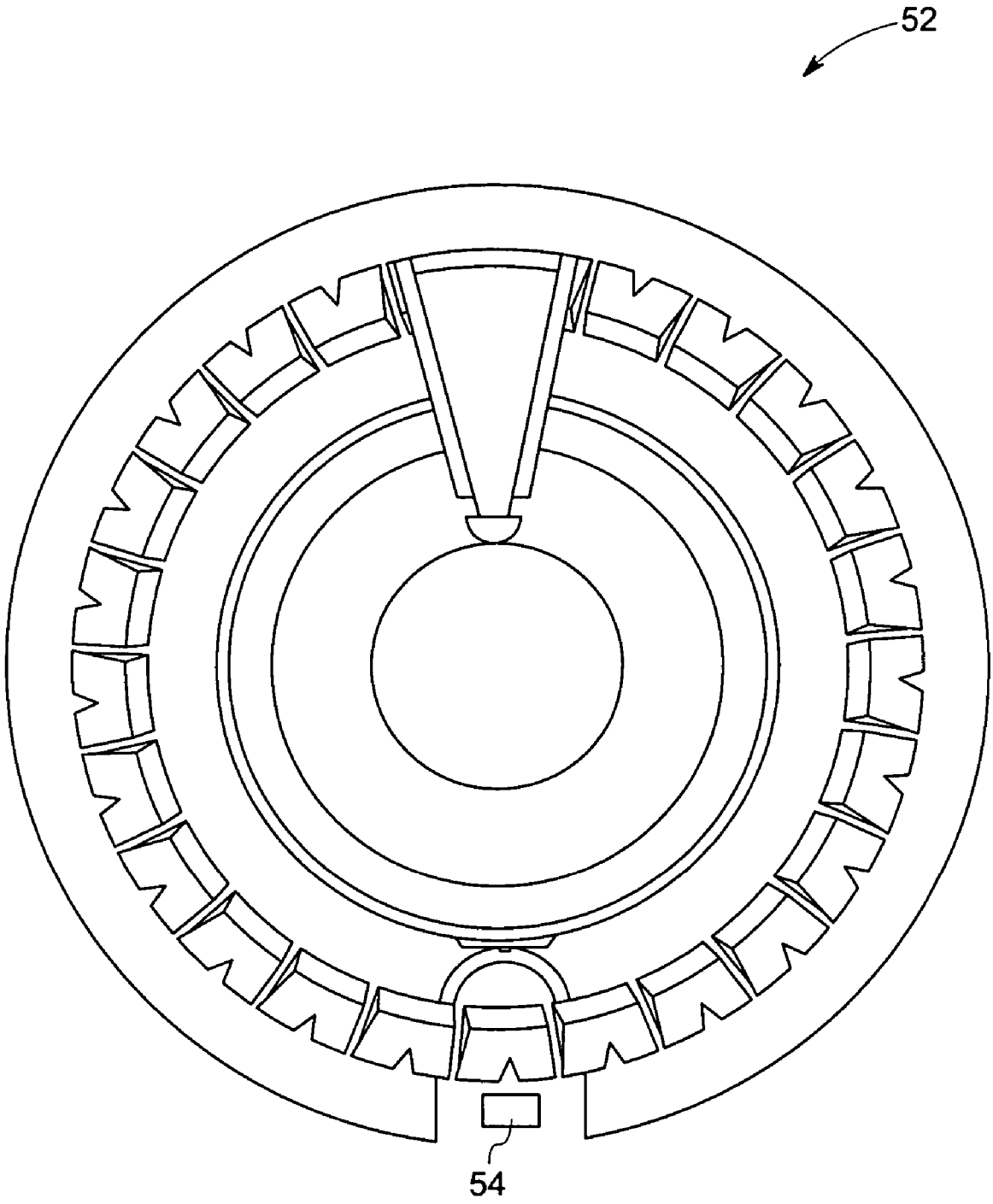
FIG. 3 is a top plan view of the gas burner of FIG. 2 in accordance with aspects of the present technique.

FIG. 2 is an exploded perspective view of a gas burner assembly 30 employed in the gas range 10 of FIG. 1. In a presently contemplated configuration, the gas burner assembly 30 includes a burner body 32 and a base portion 34. Further, the gas burner assembly 30 also includes a sidewall 36 extending from the base portion 34. The gas burner assembly 30 receives a gas flow from a gas conduit 38 having an entry area 40 and a burner throat region 42. As will be appreciated by those skilled in the art, the gas flow refers to a combustible gas or a gaseous fuel-air mixture. In this embodiment, the gas burner assembly 30 is disposed on a support surface 44, such as cooktop 14 (see FIG. 1) of a gas cooking appliance. In addition, a burner cap 46 is disposed over the top of the burner body 32 and defines a main fuel chamber 48. A toroidal shaped upper portion 50 of the burner body 32 in combination with cap 46 defines an annular diffuser region. The burner assembly 30 also includes at least one ignition device extending through an opening in the base portion 34. FIG. 3 is a top plan view 52 of the gas burner of FIG. 2. As illustrated, the gas burner 52 includes an ignition device 54 positioned adjacent to the gas burner assembly for igniting the flow of gas. The operation of the ignition device in the burner assembly 30 will be described below with reference to FIG. 4.

Figure 4:
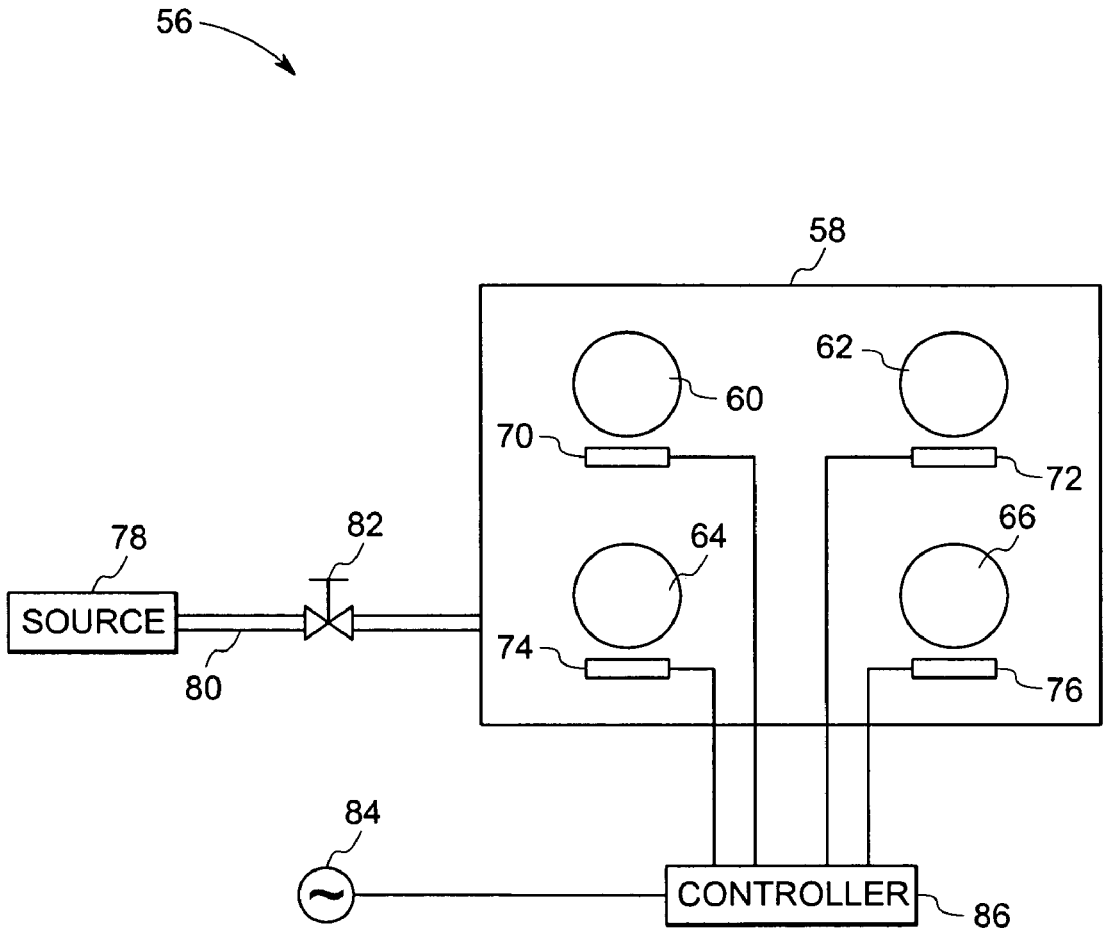
FIG. 4 is a diagrammatical illustration of an ignition device incorporated in the gas range of FIG. 1 in accordance with aspects of the present technique.

FIG. 4 is a diagrammatical illustration of a cooktop 56 of the gas range 10 of FIG. 1 having the ignition device of FIG. 3. In the illustrated embodiment, the cooktop 56 includes a supporting base 58, which in turn includes four burners 60, 62, 64 and 66 disposed on the base 58. In addition, the cooktop 56 includes ignition devices 70, 72, 74 and 76 coupled to the burners 60, 62, 64 and 66 for igniting the gas flow received by the burners. In the illustrated embodiment, the gas burners 60, 62, 64 and 66 receive a flow of gas such as natural gas, or propane from a gas source 78 via a gas conduit 80. Further, the flow of gas to the burners 60, 62, 64 and 66 is controlled by a valve 82 disposed upstream of the burners. In a presently contemplated configuration, a power source 84 is coupled to the ignition devices 70, 72, 74 and 76 to apply a voltage to the ignition devices for heating them to achieve a flame ignition temperature. Further, a controller 86 may be coupled to the ignition devices 70, 72, 74 and 76 to control the amount of voltage applied to them for ignition of the gas flows. In the illustrated embodiment, the ignition devices 70, 72, 74 and 76 include hot surface igniters that will be described below with reference to FIGS. 5 and 6.

Figure 5:
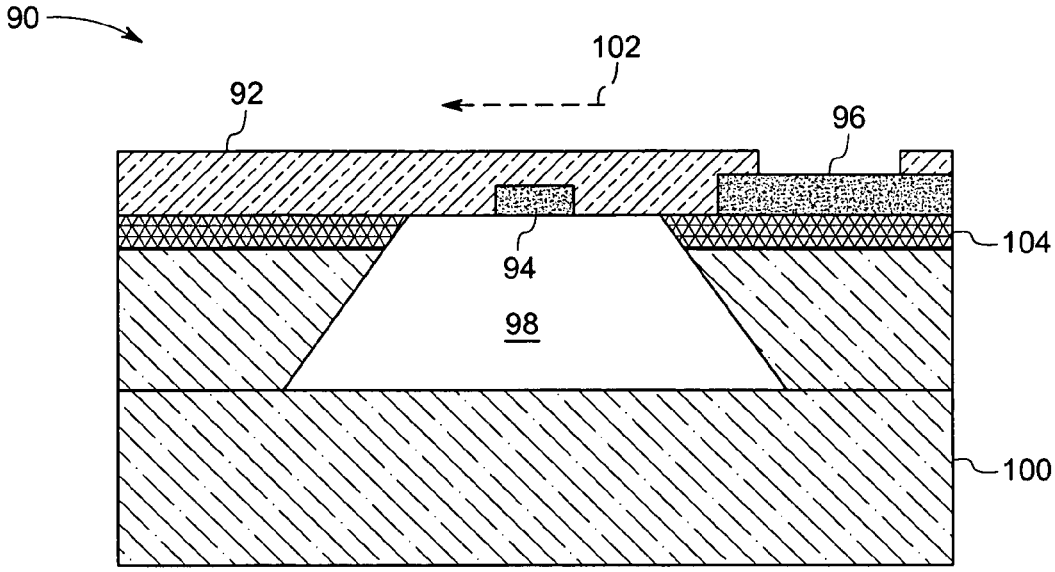
FIG. 5 is a cross-sectional view of an exemplary configuration of ignition device employed in the cooktop of FIG. 4 in accordance with aspects of the present technique.

FIG. 5 is a cross-sectional view of an exemplary configuration 90 of ignition devices 70, 72, 74 and 76 employed in the cooktop 56 of FIG. 4. In the illustrated embodiment, the ignition device 90 includes a membrane 92 and a plurality of heating elements embedded in the membrane 92 such as represented by reference numeral 94. In one embodiment, a thickness of the membrane 92 is about 4 micrometers to about 5 micrometers. The heating elements 94 are configured to heat the membrane 92 on application of voltage through the heating elements 94. In the illustrated embodiment, the heating elements 94 include a plurality of microscale resistors. In certain embodiments, the heating elements 94 are disposed at a pre-determined distance from the membrane 92. In this embodiment, the ignition device 90 also includes contact pads, such as represented by reference numeral 96 for facilitating electrical connection of the ignition device 90. Further, the ignition device 90 includes a cavity 98 disposed adjacent to the heating elements 94 and configured to provide thermal isolation of the heating elements 94. Moreover, the cavity 98 is sealed in vacuum or in an inert environment to substantially prevent degradation of the heating elements 94 by oxidation. Advantageously, the membrane structure of the ignition device with a vacuum or inert environment substantially reduces power consumption of the ignition device 90. In one embodiment, the power consumption by the ignition device 90 is in a range of about 1 watt to about 3 watts. The ignition device 90 is bonded to a silicon wafer 100 disposed adjacent to the cavity 98 for sealing the ignition device 90. In the illustrated embodiment, a non-conducting layer 104 is disposed below the doped layer 96. As will be appreciated by those skilled in the art, due to the thermal isolation of the structure of the ignition device 90, the hot surface exposed to the combustion gases will attain the temperature of the heating elements 94 in the device 90. Furthermore, the membrane 92 enables the device 90 to reach the desired temperature in a relatively short time. In certain embodiments, the time taken to reach the desired temperature is less than 2 seconds.

In the illustrated embodiment, the membrane 92 includes a non-electrically conductive high temperature material. Examples of the non-electrically conductive high temperature material include un-doped silicon carbide, silicon nitride, boron nitride, or other suitable ceramic materials. Further, the heating elements 94 include a high temperature electrically conductive material that is compatible with the membrane 92. Examples of such materials include doped ceramics and metallic materials. In the illustrated embodiment, the heating elements 94 and contact pads 96 include doped silicon carbide. In other embodiments, the heating elements 94 may include other conductive high temperature materials such as platinum, titanium, doped polysilicon, or other metals. In certain embodiments, the membrane 92 may include a plurality of layers of doped and un-doped silicon carbide to provide a gradient of coefficient of thermal expansion for substantially reducing thermal stresses. In certain other embodiments, the membrane 92 may be coated with materials that will provide a gradation in thermal properties of the device 90. In operation, a voltage is applied to the heating elements 94 via the voltage source 84 (see FIG. 4) and a gas flow 102 is ignited via hot surface ignition by the heating elements 94. Particularly, the surface of the ignition device 90 will attain the temperature of the heating elements 94 due to heat transfer from the heating elements 94 to the surface.

Figure 6:
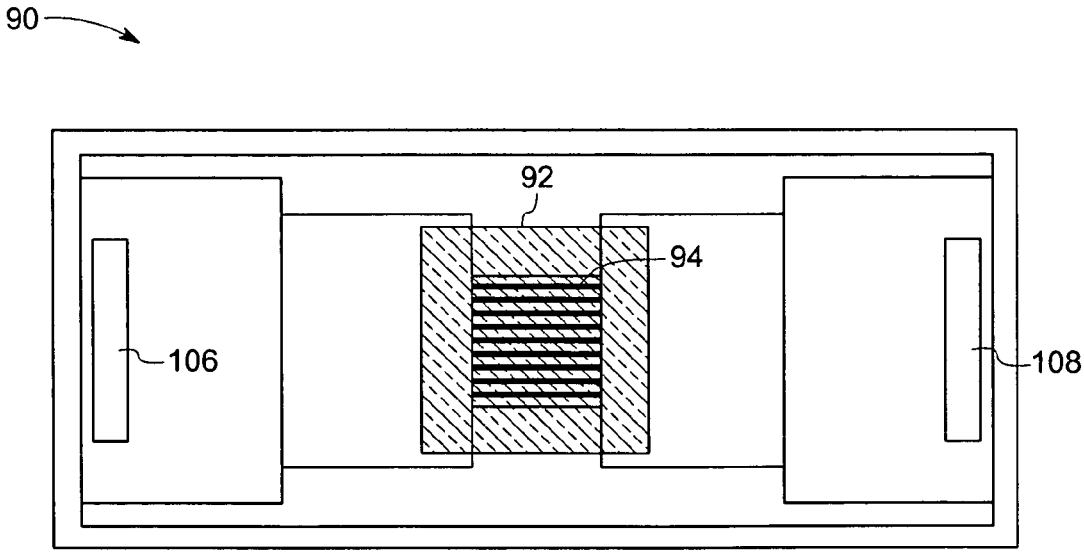
FIG. 6 is a top plan view of the ignition device of FIG. 5 in accordance with aspects of the present technique.

FIG. 6 is a top plan view of the ignition device 90 of FIG. 5. As illustrated, the ignition device 90 includes a two dimensional microplate. The microplate 90 includes the plurality of heating elements 94 embedded within the membrane 92. The heating elements 94 are configured to heat the microplate on application of voltage. In the illustrated embodiment, the heating elements 94 include a doped silicon carbide material that can sustain substantially high temperatures and harsh environments. However, other materials having similar properties may be envisaged. The microplate 90 also includes contact pads 106 and 108 for facilitating the electrical connections for the ignition device 90. In this embodiment, the contact pads 106 and 108 include doped silicon carbide. In certain embodiments, the contact pads 106 and 108 include other suitable metals. Further, a contact pad material may be deposited on the silicon carbide contact pads 106 and 108. Examples of such materials include titanium, tungsten, gold, nickel and combinations thereof.

Figure 7:
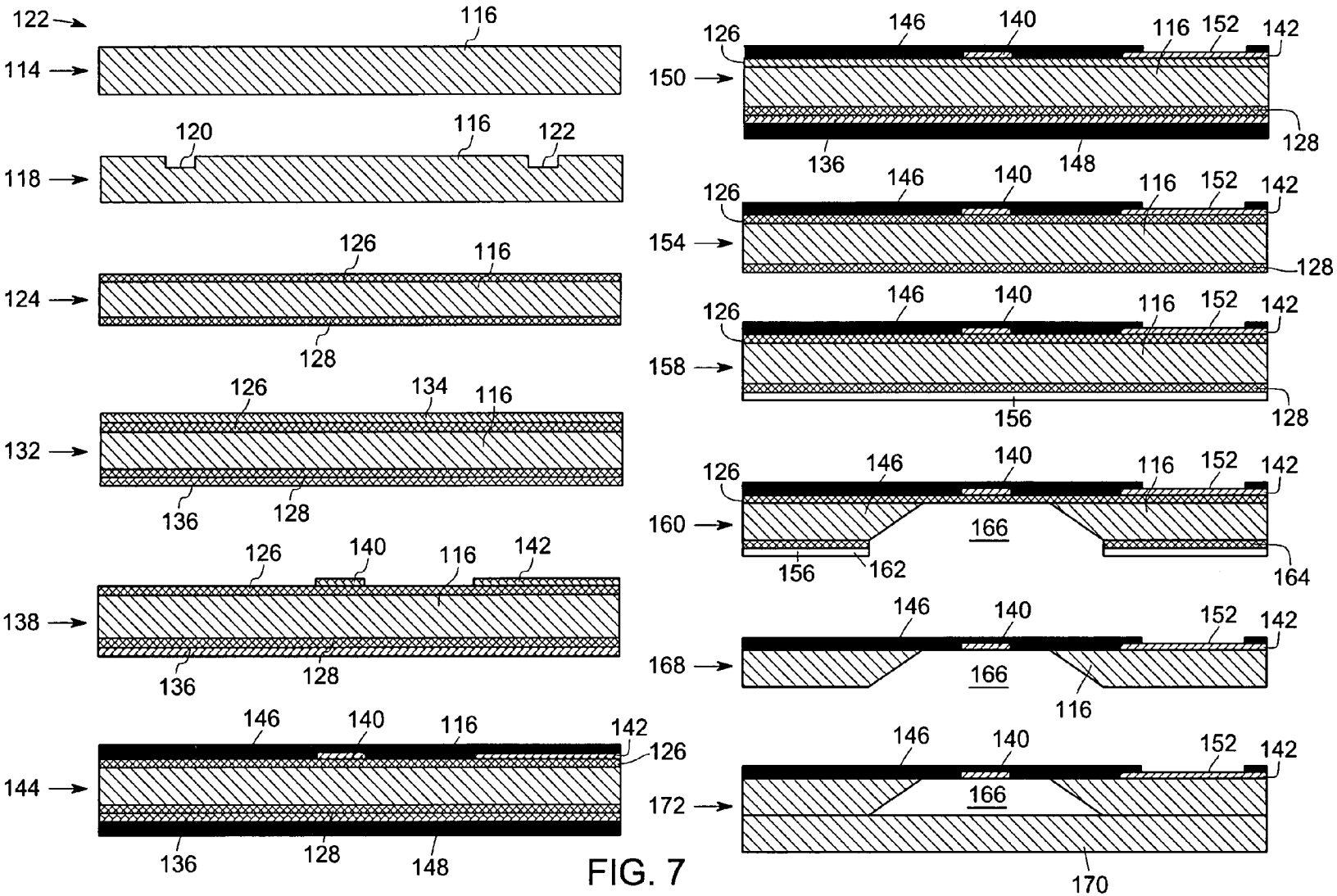
FIG. 7 is a diagrammatical representation of an exemplary process for manufacturing the ignition device of FIGS. 5 and 6 in accordance with aspects of the present technique.

The ignition device 90 described above may be manufactured through a batch semiconductor fabrication process. FIG. 7 is a diagrammatical representation of an exemplary process 112 for manufacturing the ignition device of FIGS. 5 and 6. Furthermore, various operations may be described as multiple discrete steps performed in a manner that is helpful for understanding embodiments of the invention. However, the order of description should not be construed as to imply that these operations always need be performed in the order they are presented, nor that they are even order dependent. The process begins at step 114 where a silicon wafer 116 is provided as a substrate. In this embodiment, the silicon wafer 116 includes a double-sided polished (DSP) wafer. Further, the resistivity of the silicon wafer 116 is in a range of about 1 ohm-cm to about 10 ohm-cm. At step 118, the substrate 116 is etched to create the silicon etch mask alignment marks such as represented by reference numerals 120 and 122. Further, at step 124, electrically insulative layers 126 and 128 are deposited on both sides of the silicon wafer 116. The electrically insulative layers 126 and 128 substantially prevent current flow into the wafer 116 so that the current flows through the resistive elements on the membrane 92. In this embodiment, the thickness of the silicon wafer 116 is about 300 micrometers to about 600 micrometers and the thickness of the electrically insulative layer may be from about 1 micrometers to about 3 micrometers. Examples of the electrically insulative layers include silicon dioxide, low pressure chemical vapor deposited silicon dioxide, silicon nitride and undoped silicon carbide. In one embodiment, the electrically insulative layers 126 and 128 are grown on the silicon wafer 116. In certain other embodiments, the electrically insulative layers 126 and 128 may be deposited on the silicon wafer 116 via techniques such as plasma enhanced chemical vapor deposition (PECVD), low temperature oxide (LTO) and high temperature oxide (HTO) deposition techniques.

At step 132, a layer of electrically conductive material such as doped poly-silicon carbide is deposited on either sides of the silicon substrate 116 as represented by reference numerals 134 and 136. In this embodiment, the thickness of the doped poly-silicon carbide layers 134 and 136 is about 1 micrometers and the resistivity of the doped poly-silicon carbide is about 0.01 ohm-cm to about 0.2 ohm-cm. Further, at step 138, the doped poly silicon layer 134 on the front side of the substrate 116 is etched to create heating elements 140 and contact pads 142 on the substrate 116. As previously described, the heating elements 140 may be coupled to a power source for applying a voltage to the heating element 140 for heat generation. In the present embodiment, the doped poly-silicon carbide layer 134 is masked via a photoresist masking technique, and is subsequently etched via inductively coupled plasma (ICP) etching technique. However, other etching techniques may be employed.

At step 144, an electrically insulative material such as undoped poly-silicon carbide layers 146 and 148 are disposed on the doped poly-silicon carbide layers 140 and 136. In this embodiment, a thickness of the undoped poly-silicon carbide layers 146 and 148 is about 1 micrometers to about 5 micrometers and a resistivity of the layers 146 and 148 is about 2 ohm-cm to about 20 ohm-cm. Subsequently, at step 150, the undoped silicon layer 146 is etched to form contact pad hole 152. In this embodiment, the undoped silicon layer 146 is etched via photoresist masking and ICP etching techniques. Moreover, the silicon carbide layers 136 and 148 are dry etched on the backside as represented by step 154. A layer of silicon nitride 156 is deposited on the backside of the substrate 116 via plasma enhanced chemical vapor deposition (PECVD) technique, as represented by step 158 to serve as an etch mask for step 160. However, other materials such as silicon carbide may be employed as an etch mask. In certain embodiments, the nitride layer 156 may be deposited via low pressure chemical vapor deposition (LPCVD) technique.

Further, at step 160 the oxide layer 128 is patterned and etched to form patterned oxide 162 and 164 to expose the silicon for etching. In this embodiment, a cavity 166 is formed by wet etching, such as by employing potassium hydroxide (KOH). In certain other embodiments, the cavity 166 may be formed using Deep Reactive Ion Etching. Further, at step 168, the silicon nitride layer 156 and silicon dioxide 162 and 164 are removed by employing a combination of wet and dry etch techniques, as represented by reference numeral 168. Moreover, a silicon wafer 170 is bonded in vacuum adjacent the cavity 166 as represented by step 172 to form the ignition device.

Figure 8:
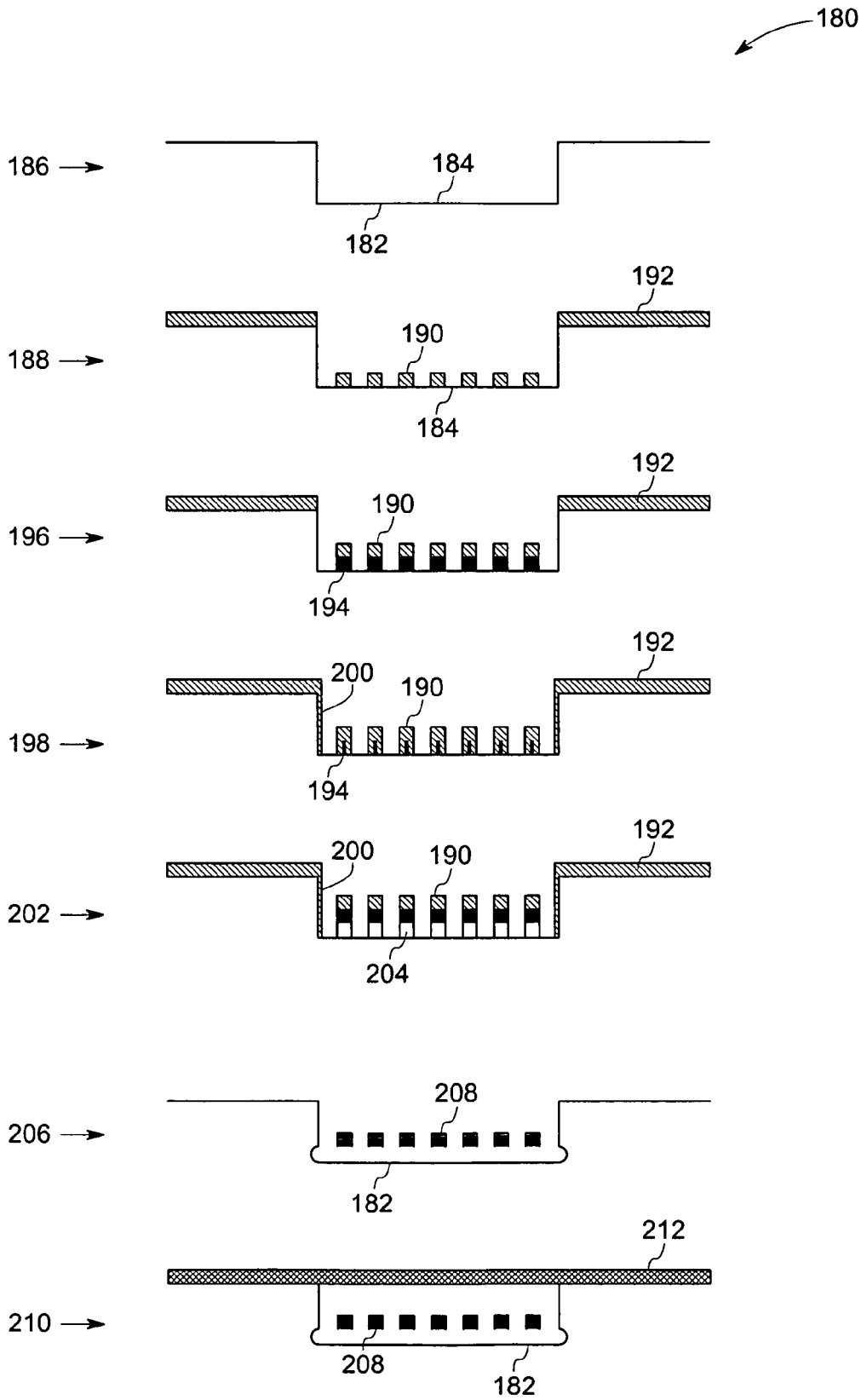
FIG. 8 is a diagrammatical representation of another exemplary process for manufacturing the ignition device of FIGS. 5 and 6 in accordance with aspects of the present technique.

FIG. 8 is a diagrammatical representation of another exemplary process 180 for manufacturing the ignition device of FIGS. 5 and 6. In the illustrated embodiment, a p doped silicon substrate 182 is etched to form a cavity 184, as represented by reference numeral 186. Next, at step 188, silicon dioxide is deposited and patterned to form lines in and adjacent the cavity 184 as represented by reference numerals 190 and 192. Further, the patterned lines 190 are etched to a required depth 194 (step 196). At step 198, thin sidewall oxide layer 200 is grown or deposited. Moreover, at step 202, the silicon etch is extended to a desired depth as represented by reference numeral 204. Next, the silicon is isotropically etched and the oxide is stripped to form the microwires 208 within the cavity, that function as heating elements of the ignition device (step 206). In one embodiment, the plurality of microwires 208 are coupled in a series arrangement. Alternatively, the microwires 208 may be coupled in a parallel arrangement. In the illustrated embodiment, the number of microwires employed in the ignition device is determined based upon a resistivity of wires 208, geometry of wires 208, an applied voltage, and the desired temperature of the device when energized. In the illustrated embodiment, the microwires 208 are made of silicon. In certain embodiments, the microwires 208 include tungsten, or molybdenum disilicide. In one embodiment, the microwires 208 include a material having a melting point that is greater than about 1200° C. Further, at step 210, a silicon carbide or a platinum coated wafer 212 is bonded adjacent the cavity 184 in vacuum to form the ignition device.

Figure 9:
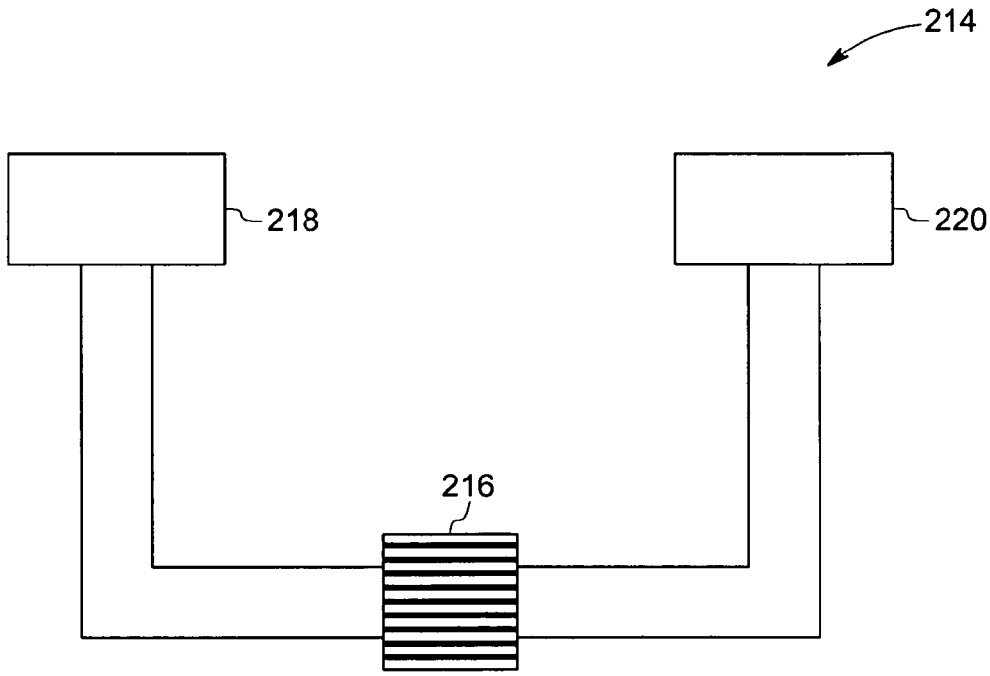
FIG. 9 is a diagrammatical illustration of an exemplary configuration of the ignition device of FIG. 4 in accordance with aspects of the present technique.

FIG. 9 is a diagrammatical illustration of an exemplary configuration 214 of the ignition device of FIG. 4. In the illustrated embodiment, the ignition device 214 has a U-shaped configuration comprising two parallel legs and a central zone. Heating elements 216 are disposed in the central zone and contact pads 218 and 220 are disposed on opposite sides of the heating elements. As described earlier, the heating elements 216 include a doped silicon carbide material that can sustain substantially high temperatures and harsh environments. However, other materials having similar properties may be envisaged. Further, contact pads 218 and 220 facilitate electrical connections for the ignition device 214. In this embodiment, the contact pads 218 and 220 include doped silicon carbide, nickel, gold, platinum, tungsten and combinations thereof. The ignition device 214 may be manufactured by exemplary processes described above with reference to FIGS. 7 and 8.

Figure 10:
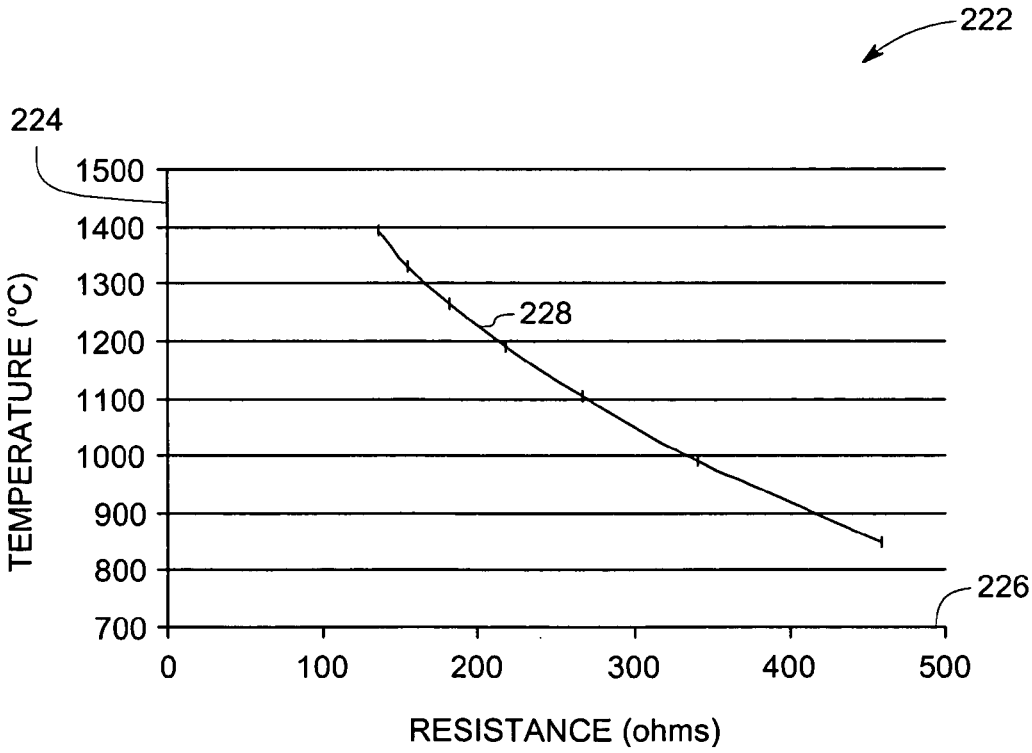
FIG. 10 is a graphical representation depicting change in resistance of the ignition device of FIGS. 5 and 6 with temperature in accordance with aspects of the present technique.

FIG. 10 is a graphical representation 222 depicting change in resistance of the ignition device of FIGS. 5 and 6 with respect to change in temperature of the ignition device. As illustrated, the ordinate axis represents temperature 224 and the abscissa axis represents a resistance 226 of the heating element of the ignition device. The profile of the change in temperature at varying resistance is represented by reference numeral 228. In the illustrated embodiment, the resistance 226 varies as a function of temperature 224, as indicated by the profile 228. Those skilled in the art will recognize that this relationship offers the potential to use the same general structure, made by the methods described above, as a temperature sensor to sense the temperature based upon a measured resistance of the heating elements (e.g., by application of a test voltage that would result in a known voltage drop as a function of the resistance).

Figure 11:
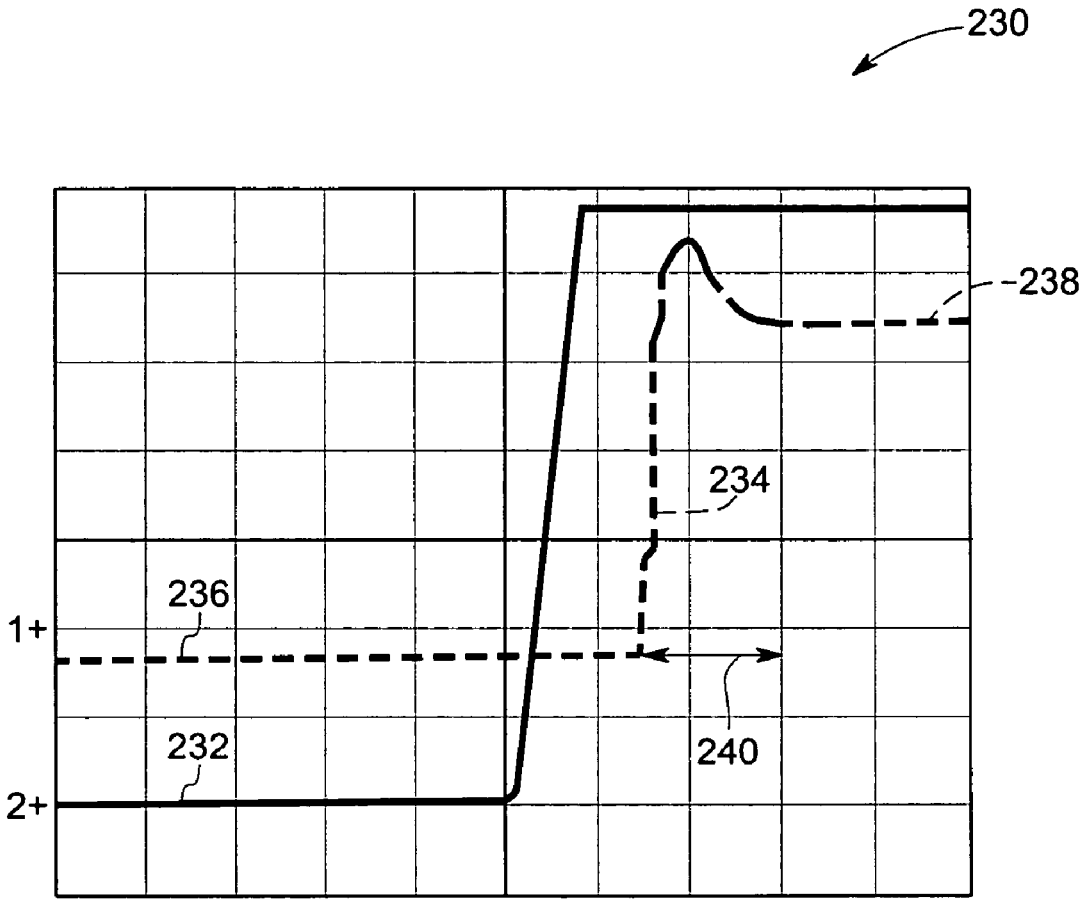
FIG. 11 is a graphical representation depicting the time response of the ignition device of FIGS. 5 and 6 to reach an ignition temperature in accordance with aspects of the present technique.

FIG. 11 is a graphical representation 230 depicting the time response for reaching an ignition temperature in the ignition device 90 of FIGS. 5 and 6. In this embodiment, the voltage applied to the ignition device 90 is represented by profile 232 and the temperature of the heating elements 94 of the ignition device 90 is represented by reference numeral 234. Initially, the ignition device 90 is at a room temperature, as indicated by numeral 236. Further, the time required by the ignition device to attain an ignition temperature 238 from the room temperature 236 is represented by reference numeral 240. It should be noted that the time 240 required by the ignition device to achieve the ignition temperature 238 is substantially less as compared to existing ignition devices. In this embodiment, the time 240 taken to attain the ignition temperature is about 100 ms.

Figure 12:
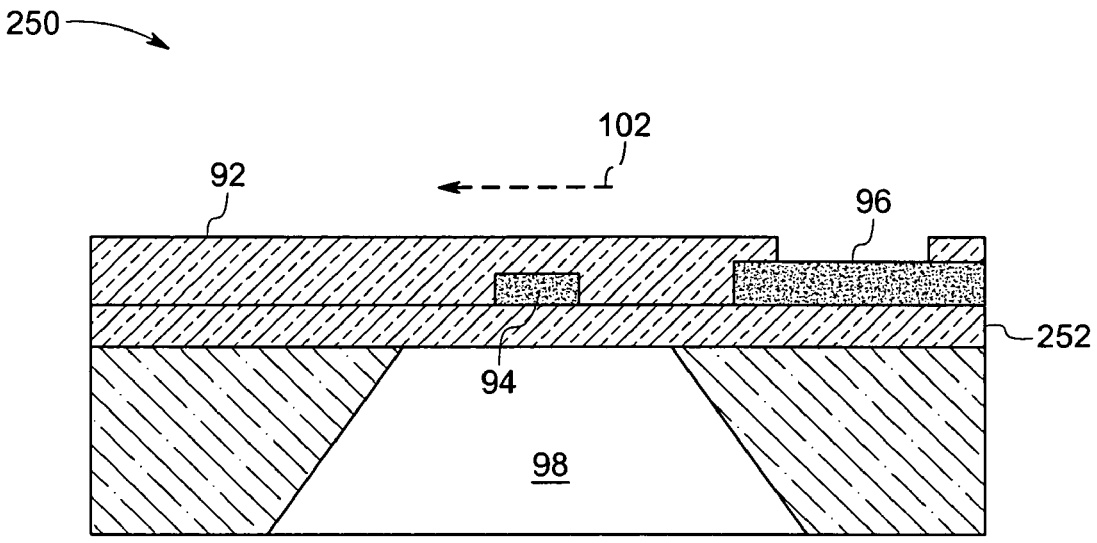
FIG. 12 is a cross-sectional view of another exemplary configuration of ignition device employed in the cooktop of FIG. 4 in accordance with aspects of the present technique.

FIG. 12 is a cross-sectional view of another exemplary configuration 250 of the ignition device of FIG. 5. In the illustrated embodiment, the ignition device 250 includes the membrane 92 and the plurality of heating elements 94 embedded in the membrane 92, as described earlier with reference to FIG. 5. The membrane 92 includes un-doped silicon carbide and the heating elements 94 include doped silicon carbide. Further, the ignition device 250 also includes contact pads 96 to facilitate the electrical connection of the ignition device 250. In addition, the cavity 98 is disposed adjacent to the heating elements. In this embodiment, a layer of un-doped silicon carbide 252 is disposed adjacent to the heating elements 94 for substantially preventing the heating elements 94 from oxidation and changing resistance. Advantageously, the additional layer of un-doped silicon carbide may eliminate the need for sealing the cavity 98 in vacuum for reaching a desired ignition temperature.

Figure 13:
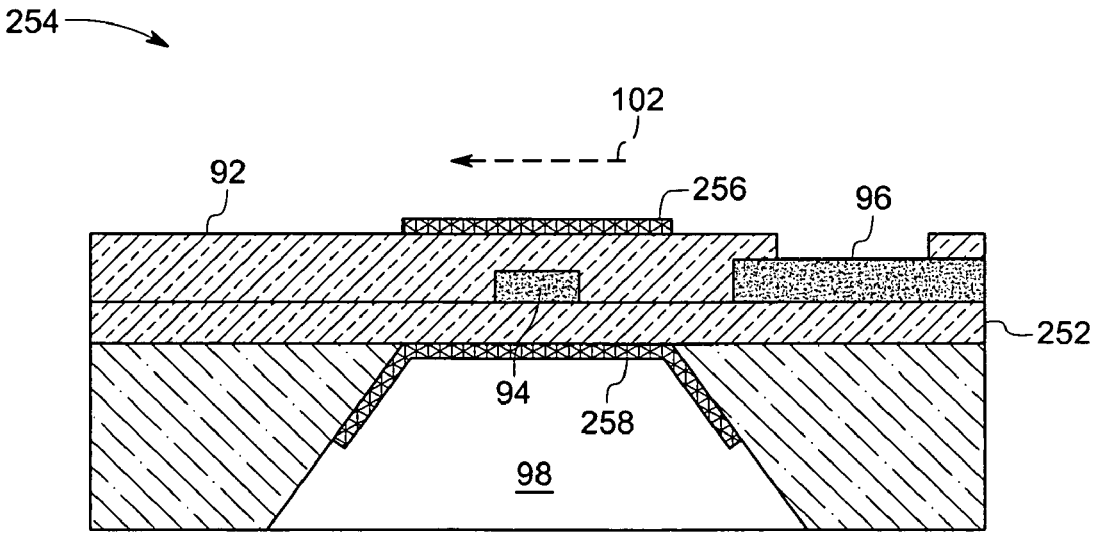
FIG. 13 is a cross-sectional view of another exemplary configuration of the ignition device employed in the cooktop of FIG. 4 in accordance with aspects of the present technique.

FIG. 13 is a cross-sectional view of another exemplary configuration 254 of the ignition device of FIG. 5. In the illustrated embodiment, the ignition device 254 includes the un-doped silicon carbide layer 252 disposed adjacent to the heating elements 94. Additionally, the ignition device 254 also includes a first oxidation resistance layer 256 disposed above the membrane 92 and a second oxidation resistance layer 258 disposed adjacent to the un-doped silicon carbide layer 252 for substantially preventing the membrane 92 and the un-doped silicon carbide layer 252 from oxidation and changing mechanical properties. As will be appreciated by one skilled in the art the ignition devices 250 and 254 may be manufactured by exemplary processes illustrated above with reference to FIGS. 7 and 8.

The various aspects of the structures and methods described hereinabove have utility in gas appliances and heating equipment, used in various applications. In particular, the ignition devices described above may be employed in gas fuel ignition applications, such as furnaces and cooking appliances, as well as in various industrial and commercial settings, such as on boilers, water heaters, industrial furnaces, and so forth. As noted above, the ignition device needs substantially less power for operation and attains the required ignition temperature within a relatively short period of time. Further, the reduction in power consumption allows for a continuous operation of the ignition device and provides the ability to maintain an energizing signal to the device while gas is flowing, so as to automatically reignite the flame if it is extinguished. Additionally, the heating elements of the ignition device are not directly exposed to the environment, thus resulting in a more robust device.

It should be noted that, as described and claimed herein, the invention offers improved structures and methods for gas appliances generally. That term is intended to be understood broadly to include both consumer appliances, as well as other gas-burning devices and systems of the types mentioned above.

While only certain features of the invention have been illustrated and described herein, many modifications and changes will occur to those skilled in the art. It is, therefore, to be understood that the appended claims are intended to cover all such modifications and changes as fall within the true spirit of the invention.

The invention claimed is:

1. A method of manufacturing an ignition device, comprising:

patterning a plurality of resistors in or on a membrane to form heating elements; and thermally isolating the heating elements from an external environment via a cavity sealed in a vacuum or in an inert environment and disposed immediately adjacent to the heating elements.

2. The method of claim 1, wherein the membrane comprises a layer of un-doped silicon carbide.

3. The method of claim 1, wherein patterning the the plurality of resistors comprises patterning doped silicon carbide material within the membrane.

4. The method of claim 1, wherein patterning the plurality of resistors comprises forming contact pads for electrical connection within the membrane.

5. The method of claim 1, wherein thermally isolating the heating elements comprises sealing the heating elements in vacuum, or in an inert environment.

6. The method of claim 1, wherein the plurality of resistors are microscale resistors.

7. A method of manufacturing an ignition device, comprising:

patterning a plurality of resistors in or on a membrane to form heating elements;

thermally isolating the heating elements from an external environment via a cavity disposed immediately adjacent to the heating elements; and sealing the cavity in a vacuum.

8. The method of claim 7, wherein the membrane comprises a layer of un-doped silicon carbide.

9. The method of claim 7, wherein patterning the plurality of resistors comprises patterning doped silicon carbide material within the membrane.

10. The method of claim 7, wherein patterning the plurality of resistors comprises forming contact pads for electrical connection within the membrane.

11. The method of claim 7, wherein thermally isolating the heating elements comprises sealing the heating elements in vacuum, or in an inert environment.

12. The method of claim 7, wherein the plurality of resistors are microscale resistors.

13. The method of claim 7, wherein sealing the cavity in a vacuum comprises bonding a silicon wafer adjacent to the cavity.

14. The method of claim 7, wherein sealing the cavity in a vacuum comprises bonding a silicon carbide or a platinum coated wafer adjacent to the cavity.

15. A method of manufacturing an ignition device, comprising:

patterning a plurality of resistors in or on a membrane to form heating elements;

thermally isolating the heating elements from an external environment via a cavity disposed immediately adjacent to the heating elements; and sealing the cavity in an inert environment.

16. The method of claim 15, wherein the membrane comprises a layer of un-doped silicon carbide.

17. The method of claim 15, wherein patterning the plurality of resistors comprises patterning doped silicon carbide material within the membrane.

18. The method of claim 15, wherein patterning the plurality of resistors comprises forming contact pads for electrical connection within the membrane.

19. The method of claim 15, wherein thermally isolating the heating elements comprises sealing the heating elements in vacuum, or in an inert environment.

20. The method of claim 15, wherein the plurality of resistors are microscale resistors.

* * * * *